United States Patent [19]

Petrovitch

[11] 4,076,777

[45] Feb. 28, 1978

[54] METHOD AND APPARATUS FOR FORMING A CONCRETE ROOF

[76] Inventor: Vladimir Petrovitch, 4 Putnam Hill, Greenwich, Conn. 06830

[21] Appl. No.: 769,399

[22] Filed: Feb. 16, 1977

Related U.S. Application Data

[63] Continuation of Ser. No. 586,366, June 12, 1975, abandoned.

[51] Int. Cl.[2] ..... E04B 1/16

[52] U.S. Cl. ..... 264/32; 249/17; 249/19; 264/35; 264/274; 425/DIG. 126

[58] Field of Search ..... 264/31, 32, 35, 33, 264/274; 249/17, 19; 425/DIG. 126

[56] References Cited

U.S. PATENT DOCUMENTS

| | | | |
|---|---|---|---|
| 820,224 | 5/1906 | Lucas | 425/DIG. 126 |
| 1,124,995 | 1/1915 | Bielenberg | 249/19 |
| 2,816,323 | 12/1957 | Munger | 264/274 X |
| 3,161,703 | 12/1964 | Watson | 249/19 X |
| 3,275,719 | 9/1966 | Dudson | 264/33 |
| 3,461,192 | 8/1969 | Di Stasio | 264/31 |

*Primary Examiner*—Thomas P. Pavelko
*Attorney, Agent, or Firm*—Kenyon & Kenyon, Reilly, Carr & Chapin

[57] ABSTRACT

Each one of a plurality of sector-shaped form members for a reinforced concrete or postensioned roof supported by a circumscribing wall, footing, columns or the like of a large building structure has an eyebolt located near its center of gravity to permit raising and lowering the form. The forms are lifted by this eye and successively positioned with their wide ends supported by brackets fastened to the circumscribing walls, footings, or columns and supported near their narrow ends by a central staging structure. If the building structure has circular walls or columns for supporting the roof, a pivoted station at the wide end of each form member provides a work platform for access to the bracket fastening means. When all of the forms are in place, their narrower ends define an opening which is centrally located. The forms are then covered by a layer of reinforced concrete. Holes are left in the roof at each eyebolt. An access opening of predetermined size is left in the center of the roof above the opening defined by the narrower ends of the forms. After the concrete has cured, the forms are each secured to the roof by the eyebolt which extends through the rod. A metal plate coupled to the eyebolt and engaging the upper surface of the rod enables the newly made roof to carry the forms. The staging is then removed through the access opening. The cable of a crane is then connected to the eyebolt of a given form. When the cable is tensioned, the load of the form is transferred from the roof to the cable and this enables the metal plate to be released from the eyebolt. The wide end of each form is then disengaged from the circumscribing wall, and each form is lowered to the bottom of the structure by the cable attached to the lifting eye. During lowering, the eyebolt and cable pass through the hole in the roof. After lowering, some or all of the forms, a lifting line is attached to each form near its narrow end such that the form will hang suspended from the lifting line with the wide end beneath the narrow end. In this position the form is hoisted by the lifting line through the access opening in the roof. The forms are then available to be placed on the wall or footing of the next structure when a plurality of structures are to be erected at a common site. If simply a single roof is being built, the forms can be reused with some modification on another project. The roof is completed by filling the holes for the eyebolts and by providing a closure for the access opening.

14 Claims, 29 Drawing Figures

D+3"

Fig. 7.
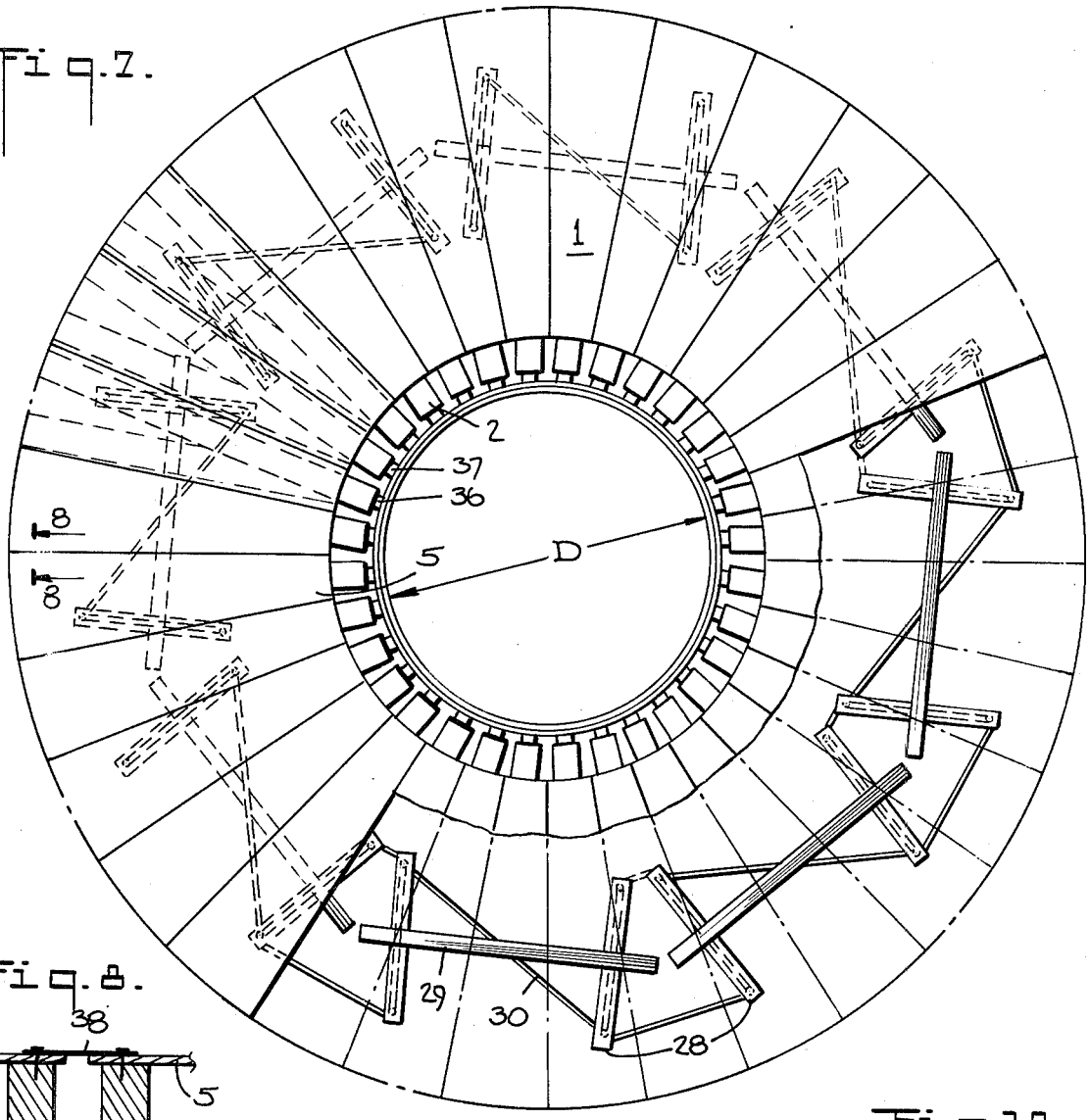
Fig. 8.
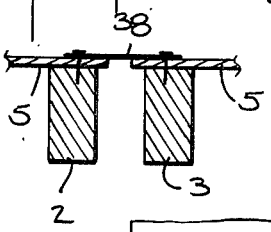
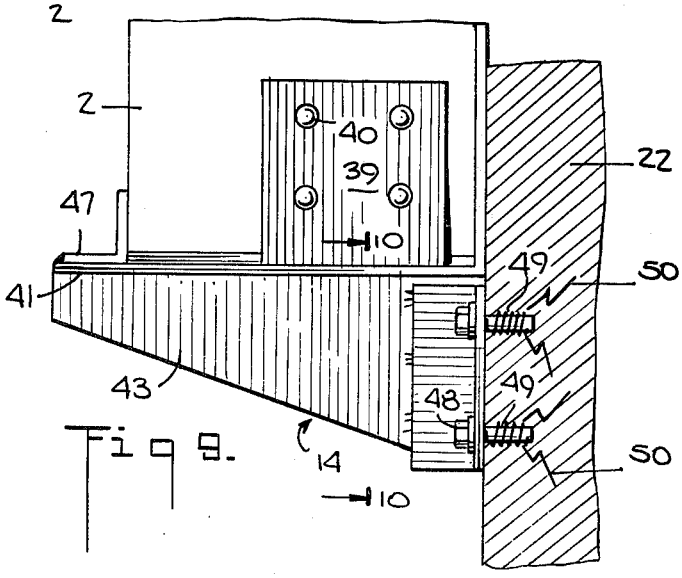
Fig. 9.
Fig. 10.
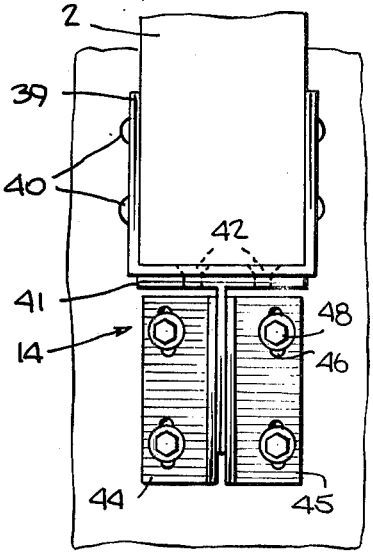

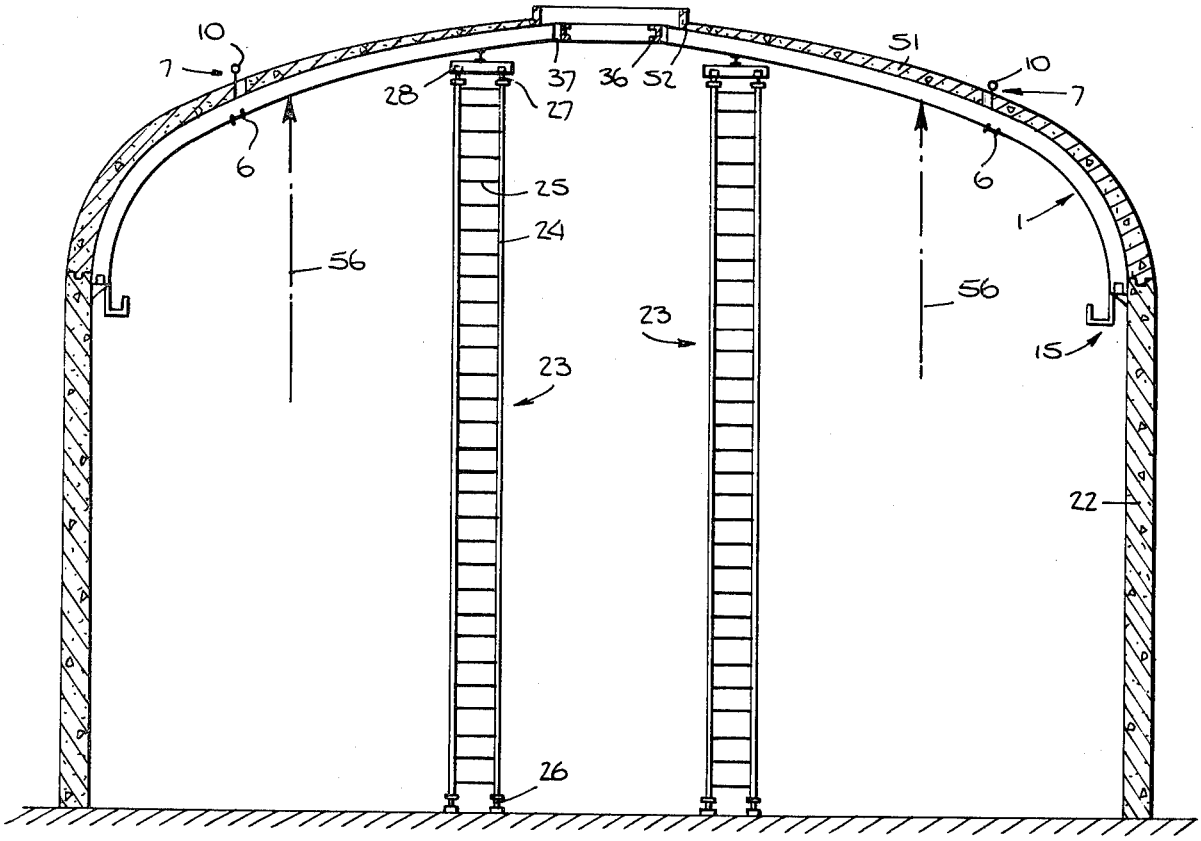
Fig. 11
Fig. 12.
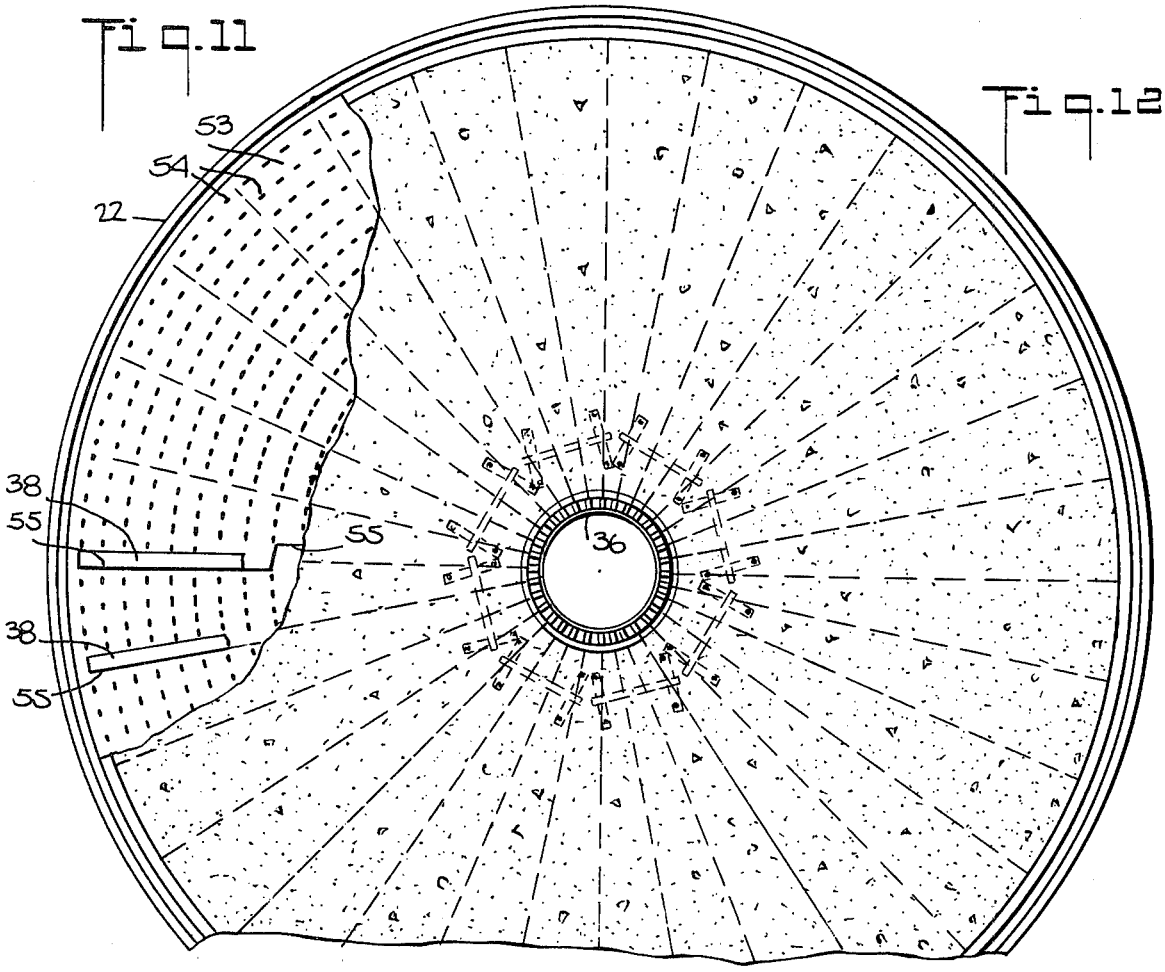

METHOD AND APPARATUS FOR FORMING A CONCRETE ROOF

This is a continuation of application Ser. No. 586,366 filed June 12, 1975, now abandoned.

BACKGROUND OF THE INVENTION

1. Field of the Invention

This invention relates to a method of construction and apparatus used in constructing large concrete shells and domes.

2. Description of the Prior Art

It is common practice when constructing roofs, shells, or domes on large concrete structures such as tanks, reactor containment vessels, sewage treatment plants, etc. to erect a complex network of staging filling the area beneath the roof in order to support the roof forms. Concrete with suitable reinforcing is then placed over the forms. This technique requires an extraordinary amount of labor, time, and material, particularly when several identical structures are to be built at the same site.

Systems comprising an attempt at avoiding this waste of manpower and material are set forth in U.S. Pat. No. 3,161,703 which issued on Dec. 15, 1964 to J. J. Watson and U.S. Pat. No. 3,854,690 which issued on Dec. 17, 1974 to O. Heinzle.

For constructing a conical roof on a large concrete tank, Watson proposes a center column for supporting a first set of horizontal radial expandable telescopic beams to underlie a work platform and a second set of downward sloping radial expandable telescopic girders for supporting plywood or other sheet material that serves as the form for a layer of concrete poured thereover. A circular platform on the top of the column forms an upper bearing ring and provides an access opening through which the expandable beams and the center column can be removed after the poured concrete roof has cured.

In the Heinzle system a plurality of radial girders rest on a flanged split collar clamped to a center support column at their inner ends, and each girder has a horizontal flange at its outer end that rests on the wall of the tank. A yieldable foam plastic pad is placed above each flange before the roof is poured. After the concrete roof has cured, the split collar on the support column is loosened and lowered. The inner girder ends are lowered on the collar, with each girder pivoting on the outer flange against the resilient restraint of the yieldable pad. The pad provides a recess to permit withdrawl of the outer flange after the inner end of the girder is free of the flanged collar. The girders can then be withdrawn from the tank through an off-center access opening, but the center column remains a permanent part of the tank.

Other patents of general interest in this art include U.S. Pat. No. 3,072,996 which issued on Jan. 15, 1963 to G. E. McGuire and U.S. Pat. No. 3,427,777 which issued on Feb. 18, 1969 to F. X. Crowley. McGuire discloses the use of radial cables in tension for supporting sector-shaped form panels of plywood or other sheet material over which a layer of concrete is poured. After the concrete has cured, the cables and a temporary support column can be dismantled and removed from the structure. The sector-shaped panels can then be stripped from the roof slab and also removed, if desired. The Crowley patent, on the other hand, discloses a method of fabricating a concrete roof structure by using precast concrete sector-shaped panels that form a permanent part of the final structure.

The foregoing patents, with the exception of Crowley, all use radial girders for supporting individually placed panels of plywood or other sheet material that serve as the skin of the form. U.S. Pat. No. 914,818 which issued on Mar. 9, 1909 to J. H. Finkle, on the other hand, teaches the use of sector-shaped "rafters" as forms for the roof of a silo. The wider end of each rafter is supported by segmental plates attached to an inner collar bearing against the wall of the silo, and the narrow ends of the rafters are secured to a central ring which may be supported by a center column. The upper surfaces of the rafters serve as forms and are covered by a layer of concrete. After the concrete has hardened, the ring may be loosened from its supporting column and disengaged from the narrow ends of the rafters, thus permitting the latter to drop freely to the bottom of the silo.

SUMMARY OF THE INVENTION

The present invention provides an improved method and apparatus for constructing a reinforced concrete roof, shell or dome of wide span, such as is required for a very large structure (e.g., a stadium). The apparatus of the invention includes a plurality of prefabricated sector-shaped form members. The method includes the steps of erecting a staging structure to approximately the designed roof height in the center of the region bounded by the circumscribing walls, columns, or footings of a tank or building structure and successively positioning each sector-shaped form member with its wide end supportably engaged by the circumscribing wall and its narrow end supported by the erected staging structure. Each form member is flanked by adjacent form members to provide a substantially continuous upper surface except for a central access of predetermined size. The upper surface of the forms is then covered with a layer of reinforced concrete.

The improvement of the present invention comprises connecting each of the form members to the roof by a connection extending through the roof to the upper surface of the roof after the concrete of the roof attained a predetermined strength. The center staging structure is then removed through the access opening in the roof. In this way the forms which originally supported the concrete now are supported by the concrete roof itself. Thereafter each form member in sequence is supported by a cable attached at its center of gravity, the connection to the roof of the form member being supported is disengaged, and the wide end of the same form member is disengaged from the circumscribing wall, footings or columns.

The method further includes lowering each form member to the bottom of the structure while it is suspended near its center of gravity. The forms are then removed by attaching a lifting line to each form member near its narrow end, such that the form member in response to its center of gravity will hang suspended from the lifting line with the wide end of the form approximately directly underneath the narrow end. The form members are then hoisted in succession by the lifting line through the access opening in the roof.

The foregoing method uses an improved sector-shaped form that has a lifting means, preferably an elongated eye bolt, that extends above the upper surface of the form at a location such that when the form is suspended from the eye bolt, it balances at approximately the angle it will assume when in place and supported by the circumscribing wall, columns or footings of the building structure and the center staging structure. In its preferred form each sector-shaped form member is curved substantially in a predetermined shape to provide a dome-shaped roof for the finished structure. In addition, each form if attached to a circumscribing wall preferably has an integral work platform pivotally attached to its wide end to enable workmen to guide successive forms in place and to attach them to the circumscribing wall of the structure. If the dome or shell is supported by footings or columns instead of a wall, the work platform may not be necessary. The length of each form is approximately equal to the radius of the tank structure, assuming it has a circular wall, minus the radius of any desired central access opening. The width of the wide end of the form is substantially equal to the diameter of such an access opening, less any amount required for clearance when removing the form from the completed structure through the opening.

In a particularly preferred manner of practicing the above-described general method, an eyebolt connected to the form extends through a hole in the roof to above the surface of the concrete roof. The eyebolt has a threaded rod portion with a beveled nut threadedly engaged thereto. Prior to pouring the concrete roof, a sleeve of fiber material, resin or the like is placed around the rod portion of the eyebolt to form a hole in the roof for lowering a cable attached to the eyebolt through the roof after the concrete has set. When the concrete roof has attained a predetermined strength, a plate having a slot is placed between the upper surface of the concrete and the nut, with the slot about the rod portion of the eyebolt. When the nut is tightened down or to the plate the eyebolt transmits the weight of the form from the center staging to the roof. With the weight of the forms removed by the eyebolts and nuts from the staging, the center staging structure is lowered until the staging in free of the forms. Lowering of the staging transfers the portion of the weight of the form carried by the staging to the roof.

The center staging structure can then be removed in sections through the access opening, thereby leaving the entire interior of the structure unobstructed. Each form member in succession can then be conveniently lowered from the roof by means of a cable engaged with the eyebolt. The cable is tightened to a predetermined load, the nut is loosened and the slotted plate is removed, thereby enabling the eyebolt and cable to pass through the hole in the roof adjacent the eyebolt as the form is lowered.

Additional features of the apparatus and the method of the invention will become apparent from the following description of the preferred embodiment, taken in conjunction with the accompanying drawings.

BRIEF DESCRIPTION OF THE DRAWINGS

FIG. 7 is an overhead view of the central portion of the roof forms after all the form members are in place, showing the arrangement of the underlying central support structure in dashed lines and a central access opening.

FIG. 8 is an enlarged detail cross section taken in the direction of arrows 8—8 in FIG. 7, showing a cover strip over the gap between adjacent form members.

FIG. 9 is a side view of a support bracket for attaching the wide end of a form member to the wall of the structure.

FIG. 10 is an elevation view of the inboard side of the support bracket of FIG. 9.

FIG. 11 is a section view in elevation of the tank and form structure after the roof has been poured.

FIG. 12 is a plan view of the tank and form structure shown in FIG. 11.

DESCRIPTION OF THE PREFERRED EMBODIMENT

Figures 1, 2, 3, 4, 5:
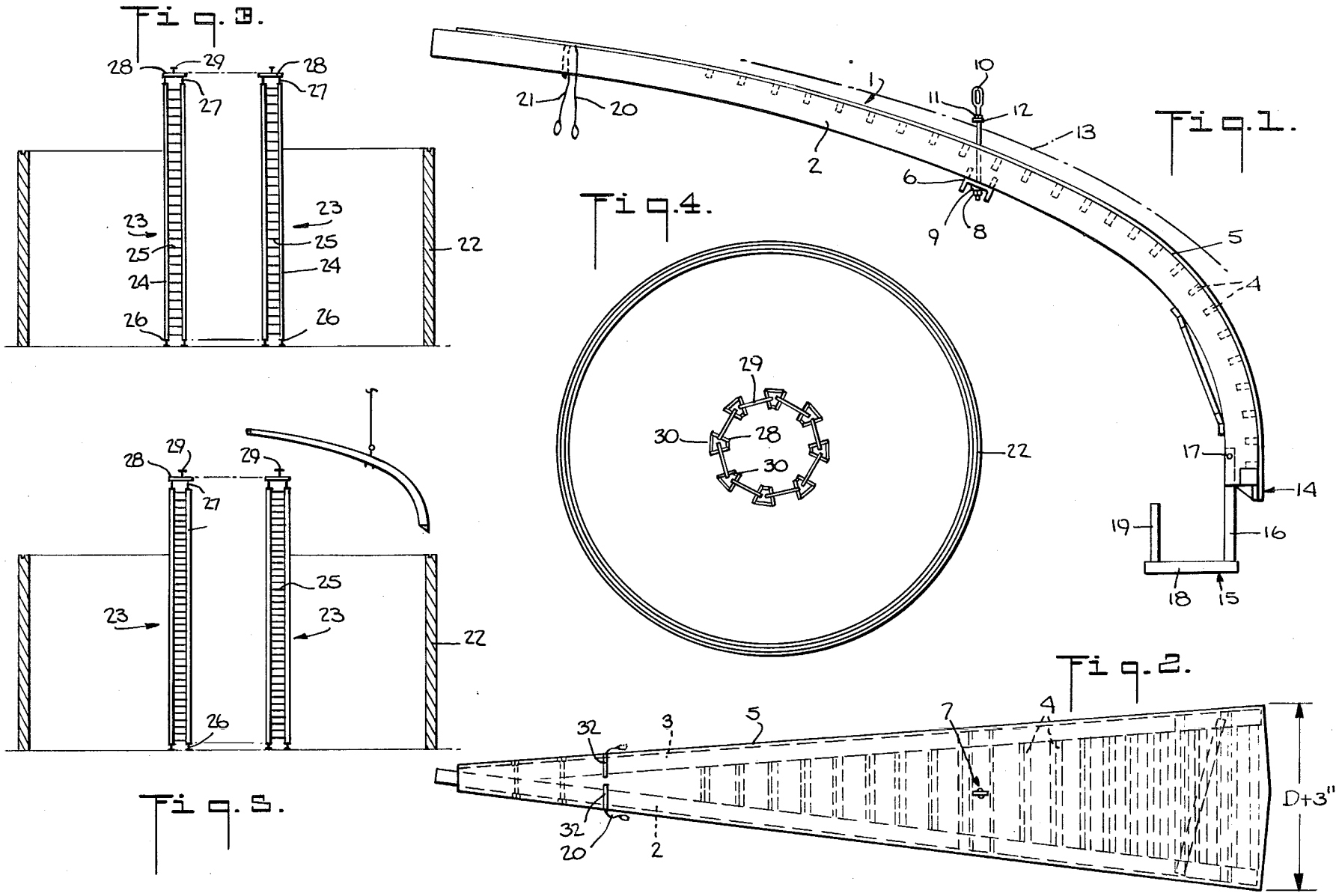
FIG. 1 is a side view in elevation of a form member according to the present invention.
FIG. 2 is a plan view of the form member of FIG. 1.
FIG. 3 is a section view in elevation of a tank structure having a circumscribing wall and with a center staging structure erected within the interior thereof.
FIG. 4 is a plan view of the tank structure of FIG. 3.
FIG. 5 is a section view in elevation of the tank structure of FIG. 3 showing a form member being set in place.

The basic component of the present invention is a sector-shaped form member 1 shown in elevation in FIG. 1 and in plan view in FIG. 2. The form member is constructed with at least one support beam and preferably two support beams 2 and 3, which extend in converging planes as shown in FIG. 2. These beams may be straight or curved convexly upward in a desired shape as shown in FIG. 1. They may be constructed of any suitable material, such as laminated wood, steel, etc.

The two support beams 2 and 3 are joined by longitudinally spaced ribs 4 which provide rigidity to the beams and stiffness to an outer skin 5 of sheeting, such as plywood, sheet metal, etc. As shown in FIG. 2, the outer skin overlaps the exposed outer faces of the support beams by a small amount (approximately 1 inch) to provide a clearance space for lifting cables attached to the beams and to facilitate lowering of the same.

The form member also includes a cross beam 6 (FIG. 1) extending laterally between the support beams at the center of gravity of the form member. An elongated lifting means in the form of an eyebolt 7 is attached at its lower end to the center of cross beam 6 with a nut 8 and a tapered washer 9. The threaded bolt of the eyebolt extends above the surface of the outer skin of the form member to terminate in a lifting eye 10 at the upper end of the bolt. A stop nut 11 and second tapered washer 12 are positioned on the threaded shaft of the eyebolt and spaced above the surface of the skin of the form by a distance greater than a predetermined thickness of the concrete roof to be poured, The upper surface of the roof being indicated by a dashed line 13.

The attachment point of eye bolt 7 to the cross beam is located approximately at the center of gravity so that when the form is suspended from lifting eye 10, it will balance in a position that is approximately the same as that intended when the form is in position on a structure.

Also shown in FIG. 1 is a bracket 14 attached to the end of support beam 2 (an identical bracket is attached to support beam 3) adjacent to the wide end of the form member. The bracket is adapted to support that end of the form member in engagement with the inner surface of a circumscribing wall. A work platform designated generally by numeral 15 is located adjacent to bracket 14 at the wide end of the form member. The work platform comprises a pair of elongated support members 16 pivotally attached at their upper ends on a pipe 17 extending into support beams 2 and 3 parallel to the wide end of the form member (see also FIG. 6). A working platform with walkway 18 is attached perpendicularly at one of its edges to the other end of the support members, and a guard rail 19 extends upwardly from the other edge of the walkway. The length of support member 16 is such that when the work station is in the position shown in FIG. 1, the walkway will hang below the ends of the support beams of the form member by itself and by a distance sufficient to provide easy working access to brackets 14. In this way the work station facilitates bolting and unbolting the brackets from the above-mentioned circumscribing wall of the structure.

A pair of bridles 20 and 21 are attached, one to each of the support beams 2 and 3, near the narrow end of the form member. The location of the attachment of the bridles is at the vertical center of gavity. The preferred manner of attaching these bridles will be described below in connection with FIG. 6.

The above-described form member is used in the construction of a roof for a large structure having a circumscribing wall or footing, according to the method of the invention described below. Such a structure may be a large tank, such as sewage tanks, having a diameter of 90 feet or more, or it may be a large building structure, such as a stadium or other building, designed to have an interior unobstructed by roof support columns and so on. The application of the method of the present invention to the construction of a domed roof for a large tank is illustrated in FIGS. 3 and 4 in which a cylindrical tank wall 22 forms a circumscribing wall of predetermined height.

The method of the present invention includes as a preliminary step the erection of a central support structure or staging within the circumscribing wall, preferably in the form of scaffolding towers 23 as shown in FIG. 3. Each of these towers is assembled in sections of standard height to the desired total height in relation to the height of wall 22 or supporting columns or footings. Each scaffold section comprises a pair of vertical posts 24 joined by cross members 25. Screw jacks 26 at the bottom of each scaffolding tower and screw jacks 27 at the top of each tower permit vertical raising and lowering adjustments to achieve the desired total height and for other purposes to be described below. Pick-up beams 28, simply supported by the screw jacks 27 on the top of each scaffolding post, carry I-beams 29 which are arranged in an approximately circular fashion as shown in the plan view of FIG. 4. I-beams 29, in turn, provide a horizontal bearing surface for the underside of support beams 2 and 3 near the narrow end of each form member.

FIG. 3 shows only the two scaffolding towers that lie in the plane of the section, in order to avoid complicating the drawing, but the central support structure comprises a number of these towers arranged approximately radially in a circle concentric with the circumscribing wall, as shown in FIG. 4. Each of the scaffolding towers 23 is connected to the adjacent towers by suitable cross bracing 30 as shown in FIG. 4, and more clearly in FIG. 6.

FIG. 5 illustrates, in the same schematic fashion as FIG. 3, the next step of lowering the first form member into place and shows the advantage of suspending the form member at a single balance point such that it assumes approximately the position intended after it is supported on the circumscribing wall and the central support structure. It is thus a relatively easy matter to guide the form member, which may weigh many tons, into precise position. In this respect, it may be desirable to balance the form member so that its wide end will come to rest on the wall support before the narrow end reaches the level of the central support. This will stop any pendulum motion in the radial direction that otherwise could damage either the form member or the top of the wall. At the same time, the form member can be easily pivoted about its contact point on the central support for alignment circumferentially with bracket attachment holes on the inner face of the wall.

Figure 6:
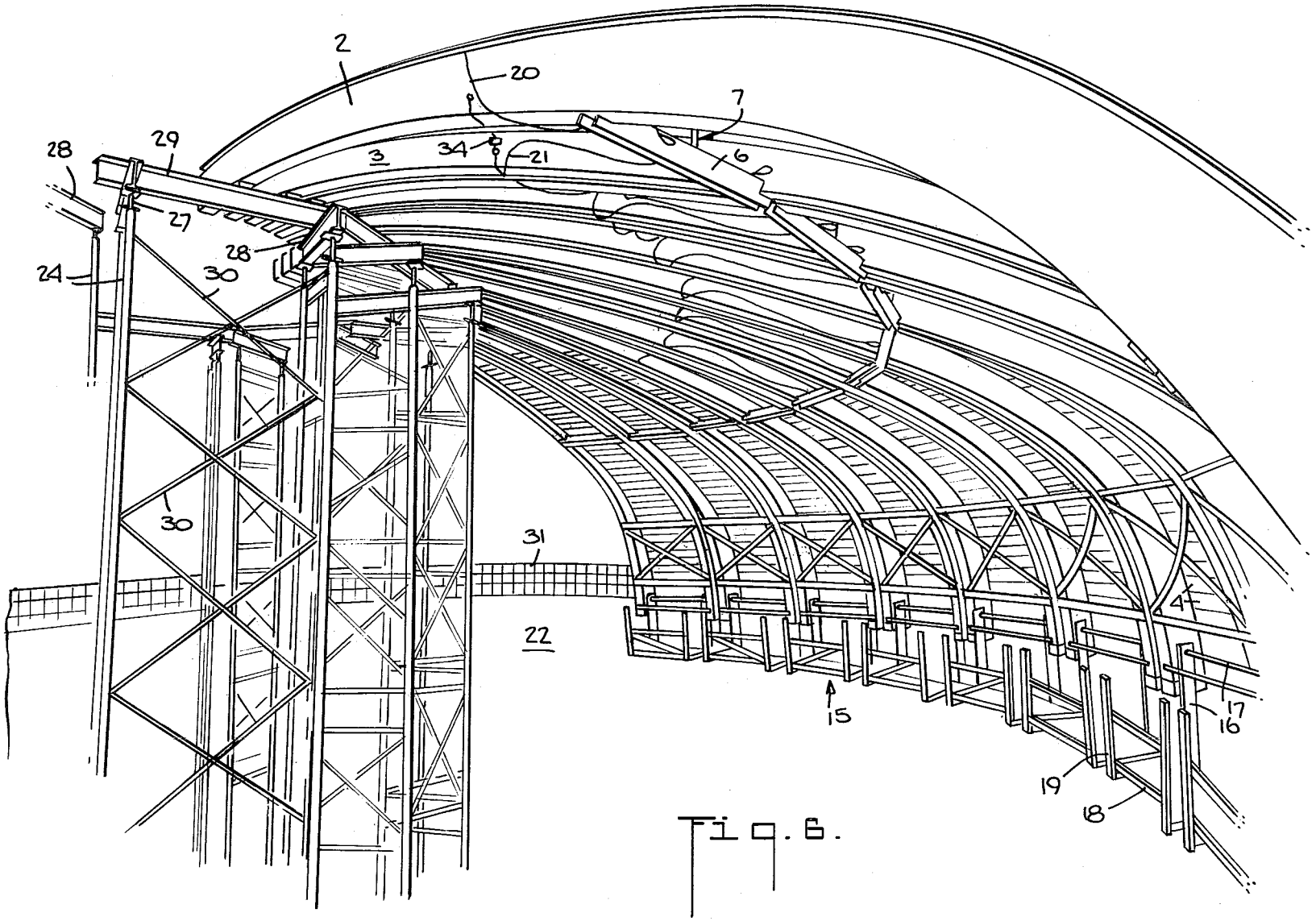
FIG. 6 is a perspective view from inside a tank structure showing a plurality of form members positioned with their wide ends engaging the top of the circumscribing wall of the tank and with their narrow ends resting on top of the central support structure.

FIG. 6 provides a perspective view of an ensuing stage of form erection in which a number of the form members have been placed side by side to span between the circumscribing wall and the central support structure. This view provides a clear picture of the manner in which the scaffolding towers are cross braced and the arrangement of upper screw jacks 27, pick-up beams 28, and I-beam supports 29.

Also shown in FIG. 6 is the walkway around the inner perimeter of the tank wall created by the individual work platform 15, each of which is integrally assembled with its corresponding form member. Thus, no scaffolding need be erected to support the walkway, which provides a convenient platform for workmen guiding each succeeding form member into position to secure the support brackets 14 to the wall.

To the left of the roof forms is shown a grid of steel reinforcing bars 31. These are extensions of the reinforcement provided in the circumscribing wall and tie into other reinforcing bars to be placed in the roof; so that the wall and roof will form an integral, monolithic structure.

FIG. 6 also shows the manner of assembly of cross beams 6 with the support beams 2 and 3 of each form member and the preferred way of attaching bridles 20 and 21 to the support beams. Two transverse slots 32 (see also FIG. 2) in the plywood skin of each form member extend inwardly from the opposite edges of the skin to terminate slightly inboard of the inner faces of the respective support beams. One end of each bridle threads down through a corresponding one of the slots between the inboard end of the slot and the corresponding beam, then wraps outwardly and upwardly around the bottom and side of the beam, and then threads through a transverse hole 33 in the beam at approximately its neutral axis. The one end of the bridle is then attached to the adjacent running part thereof either by clamps 34 or by splicing. The free end of each bridle is formed into a loop 35 for attachment to a crane hook in conventional fashion.

Before the form members are lifted into place, the bridles are laid into the transverse slots 32 and either hang down, as shown in FIG. 1, or have their free ends tucked over cross beam 6, as shown in FIG. 6. In this way, a smooth upper skin surface is provided so that no grooves will be formed by the bridle cables in the undersurface of the subsequently poured concrete roof. If liner material is applied to the forms as discussed subsequently herein, the liner material prevents the concrete from contacting the bridles or slots. If no liner is used, the slots are taped to cover them before concreting.

Referring next to FIG. 7, an enlarged detail of the center portion of the completely installed roof forms is shown. The forms are cut away in the lower right quadrant to show in greater detail the central staging structure arrangement of FIG. 4. It will be noted that the radial span of the form members is less than the inner radius of the circumscribing wall by an amount sufficient to provide clearance space for a compression ring 36 having a diameter D. Ring 36 is preferably rolled from a steel channel member with the flanges facing inward. Wedges 37 are placed between the outer surface of the compression ring and the inboard end of support beam 2 of each form member to adjust for variations in length of the individual beams and in the radial distance to the circumscribing wall. These wedges then transmit to the compression ring the radial compression forces created in the support beams by the weight of the subsequently poured concrete roof.

Compression ring 36 also performs the additional function of providing an access opening for workmen and materials to the interior of the tank.

It will be noted that only one of the two support beams of each form member extends beyond the inner end of the skin so as to provide lateral clearance for the inner ends of adjacent form members. The other support beam is scarfed to the first beam at a location slightly outboard of the inner end of the first beam, as shown by dashed lines in the upper left portion of FIG. 7, and also in FIG. 2.

To facilitate removal and lowering of the form members, the form members are designed wit a clearance gap between the edges of the skins of adjacent forms that may be as large as 1 inch, or even more, in order to be sure that there will be no interference between forms when all are in position. Referring to FIG. 8, an enlarged section of the gap region between adjacent form members is shown. To prevent leakage or sag of the concrete roof layer through the gap, a strip 38 of plastic or metal, such as a strip of polyvinyl chloride ⅛ inch thick by about 4 inches wide, is lightly tacked along the entire gap length between each adjoining pair of form members. The tacks are preferably only strong enough to hold the strip in place under the pressure of the concrete. The tacks will pull out of the form members easily in the subsequent operation of lowering the form members to the bottom of the tank.

FIGS. 9 and 10 illustrate in detail a preferred form of bracket 14 for attaching the outer end of each form member support beam to the inner surface of the circumscribing wall 22. Each bracket 14 comprises a U-shaped stirrup 39 for receiving the lower end of a support beam. Stirrup 39 is fastened to the beam by bolts 40 through the upright legs of the U-shaped stirrup and to an underlying horizontal plate 41 by flat-head bolts 42 through the base of the U-shaped stirrup. A T-shaped beam is connected by flange 41 to the stirrup. Angles 44 and 45 are attached even with the outer vertical edge of the T-shaped beam. Spaced elongated bolt holes 46 in the outer flange of each angle 44, 45 provide vertical adjustment for aligning the bracket with precast bolt holes in the inner surface of wall 22.

Another angle 47, welded to the inward end of horizontal flange 41 serves as a toe plate for properly locating bracket 14 on the end of the beam so that the outer faces of angles 44 and 45 are aligned with the outer edge of the bottom of the beam. This permits attachment of the bracket to the wall by bolts 48.

As shown particularly in FIG. 9, bolts 48 are engaged by coil inserts 49 that provide steel threads for the bolts. The ends 50 of the coil inserts are flared and crimped, as shown, to anchor the inserts into the surrounding concrete of the wall. Such coil inserts are commercially available and are initially screwed onto bolts 48 and located by a suitable template before the top of concrete wall 22 is poured. After the wall is poured and has set, the bolts can be unscrewed from the anchor coils to allow fitting of each corresponding bracket 14 against the wall.

Referring next to FIGS. 11 and 12, after all form members are in place the concrete roof 51 is poured. The roof can be finished off with a compression ring 52 for receiving a center covering (not shown) of plastic or other suitable material after the tank is completed. The opening can also be permanently closed with concrete or metal material.

Although the concrete for the roof can be placed directly onto the skin of the form, after coating the skin with a suitable release agent, in many situations it may be desirable to provide an inner lining for the roof. This is particularly true in the specific application to sewage tanks mentioned above because of the corrosive nature of the materials being treated. In such a situation, a plastic lining can be created easily by the use of commercially available rolls of plastic sheeting having studs molded into the plastic in spaced rows and columns and extending from one surface of the plastic sheet.

A sheet of such plastic is unrolled to cover the entire skin of each form member before the member is lifted into place on top of the tank wall. One edge of the sheet is aligned with one edge of the plywood skin, and any excess width of plastic is folded back on the other side of the form to leave the other edge of the skin exposed. The plastic is unrolled with the studded side up and may be tacked down lightly to hold it in place. The form is then hoisted to the top of the tank and set into position adjacent to the preceeding form. Next the plastic bridging strip 38 (FIG. 8) is tacked in place over the gap between the forms, and the folded excess width is unfolded to overlie the bridging strip.

The cutaway portion of FIG. 12 illustrates the above-described arrangement. On each form member the righthand edge (not shown) of a plastic sheet has been aligned with the right-hand edge of the form, when looking radially inward. The left-hand edge 55 of the sheet is initially folded back on itself (as shown illustratively on the lower two form members exposed by the cutaway portion) to allow installation of the bridging strip 38 between each pair of adjacent form members. The left-hand edge 55 is then unfolded to cover the bridging strip and overlap the adjoining plastic sheet to provide a continuous lining with no gaps, as shown by the upper part of the cutaway portion of FIG. 12. The edge portions of the plastic sheet are secured by heat sealing one layer to the other.

When the layer of concrete is subsequently poured to form the roof of the tank, the studs are integrally imbedded in the concrete so that the plastic lining adheres tightly to the underside of the roof when the form members are subsequently lowered.

As stated earlier, the laminated wood form members illustrated as the preferred embodiment are suitable for tank diameters up to approximately 100 feet without requiring additional support. Similar forms may be used for tanks or other structures of much larger diameters, but in such cases it may be necessary to provide intermediate supporting structure at the general location indicated by arrows 56 in FIG. 11. For wide spans, the forms can be constructed as trusses for increased bending strength. Such structure can be of any conventional type, as will be appreciated by those skilled in the art, and need not be further illustrated.

Figure 13:
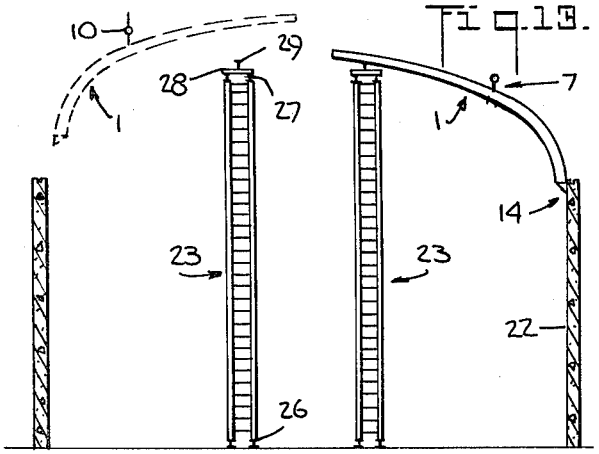
FIG. 13 is a section view in elevation depicting a stage in the assembly of the roof forms subsequent to that shown in FIG. 5.

With reference to FIGS. 13 through 20, these figures illustrate in schematic fashion the series of steps according to the improved method of the present invention to complete the construction of a poured concrete roof for a large tank or similar structure following the preliminary steps described in connection with FIGS. 3 and 5. In FIG. 13, the form member on the right-hand side is in place, with bracket 14 bolted to the inner face of wall 22; while the form member shown in dashed lines on the left is being lowered into position. As mentioned earlier, the form members normally will be installed successively side-by-side, but they can be placed in any convenient order since the tapped holes in wall 22 have been prelocated by means of templates to establish the proper angular position of each form.

Figure 14:
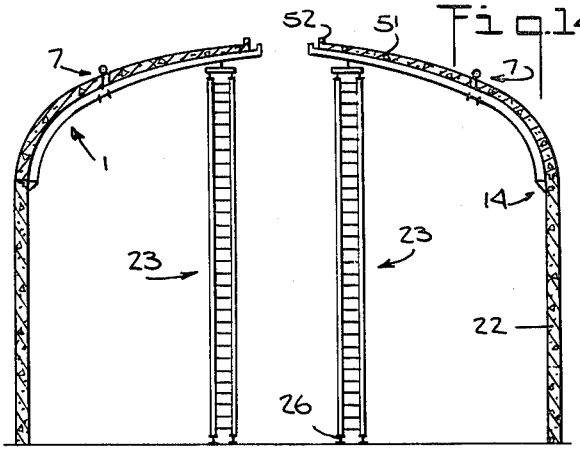
FIG. 14 shows a subsequent construction stage after the roof has been concreted.

All forms are in position in FIG. 14, compression ring 36 has been wedged in place, and a layer of concrete is being poured over the forms, as shown on the right side of the figure. In pouring the roof for a large structure, it is usually desirable to lay the concrete along a radial line and sweep progressively around the circumference. This technique assures that any joint between freshly laid and already hardened concrete will lie along a radial line, parallel to the direction of principal compression stress in the completed roof. On the other hand, if pouring is started along the circumference of the roof, there is a danger of forming arcuate joints between successively poured concentric "rings" of concrete that may fracture under the compressive roof loading.

Figure 15:
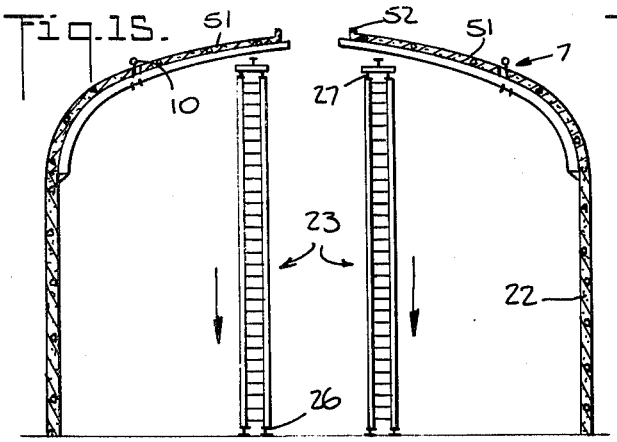
FIG. 15 illustrates the step of lowering the center staging structure so that the form members are suspended at approximately their centers of gravity from the concrete roof by means of the nuts of the eyebolts tightened against the slotted plates.

FIG. 15 illustrates a step in lowering the center staging or scaffolding after the concrete roof has cured to a predetermined strength. At that time, the task of carrying the weight of the forms has been transferred from the central staging structure underneath the forms to the overlying roof above the forms. This load transferring step is one principal feature of the method of the present invention, and a preferred manner of accomplishing it will be described in detail below in connection with FIGS. 23 through 26.

Preferably, the transferred weight of each form member is carried by the lifting means 7 located at the center of gravity of the beam and distributed to the surrounding concrete through a slotted bearing plate.

Figure 16:
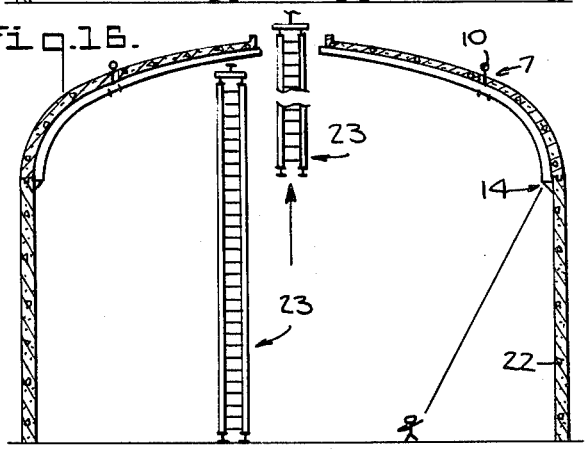
FIG. 16 illustrates the step of removing the staging structure through the access opening.
Figure 17:
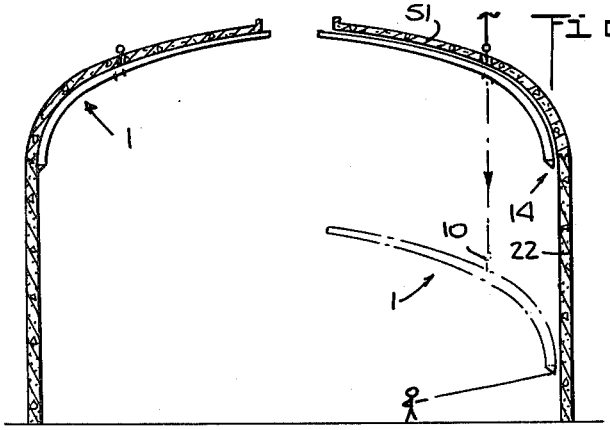
FIG. 17 illustrates the step of lowering a form member to the bottom of the tank.
Figure 18:
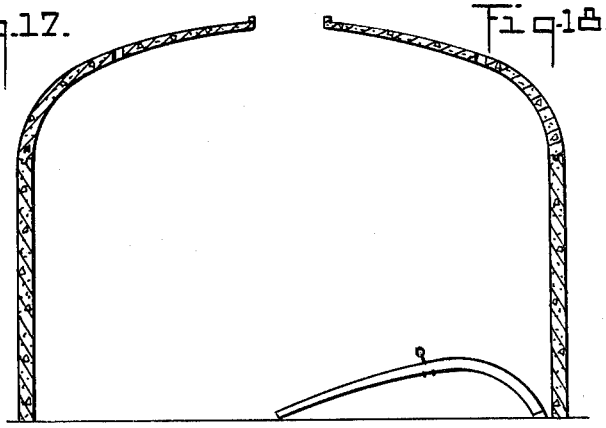
FIG. 18 depicts a form member lying on the bottom of the tank.
Figure 19:
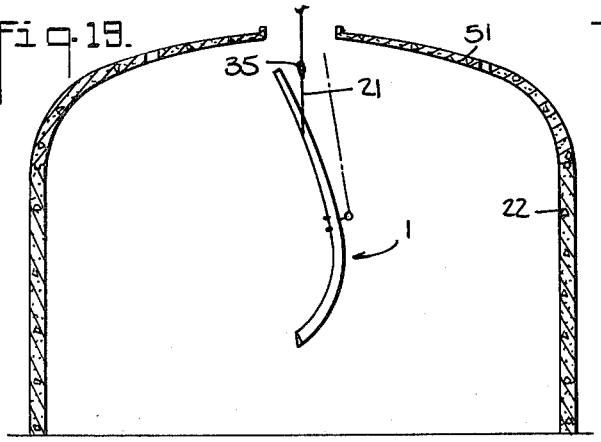
FIG. 19 illustrates the steps of lifting a form member at a location near its narrow end so that the wide end is suspended substantially directly below the narrow end.
Figure 20:
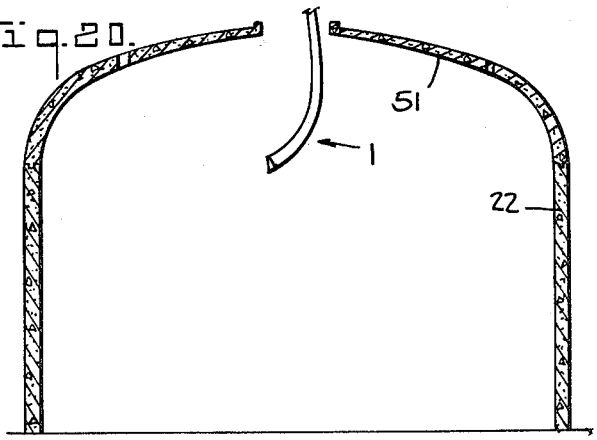
FIG. 20 illustrates the step of removing the form member through the access opening.

After all the form members have been suitably secured to the roof, compression ring 36 is removed, and the central staging structure is lowered out of contact with the inner ends of the form members by retracting screw jacks 26 and/or 27, as shown in FIG. 15. The I-beam supports 29 are then lowered with the staging. Each scaffold tower 23 is then hoisted out in its assembled form through the access opening, as illustrated in FIG. 16. This leaves the interior of the tank completely unobstructed; so that the form members can be lowered to the bottom without damage to the forms or to any support structure in the tank.

The next step is to screw nut 12 upwardly towards the eye which will lower the forms for approximately ¼ inch. Then a line is hooked to eye 10 of the lifting means of a form member. Tension is applied to lift the form slightly to free the slotted bearing plate mentioned above. Then bracket 14 is unbolted from wall 22. Finally the form member is lowered to the bottom of the structure, as shown by dashed lines in FIG. 17. To facilitate the release of the brackets, the lower two bolts of each bracket are removed in advance. Thus, when the line is supporting the form, it is simply necessary to remove the upper bolts to free the brackets.

When the form rests on the bottom of the tank, the crane hook is disconnected from eye 10, and the procedure is repeated for the next form members. Depending on the number of forms, normally it is most efficient to lower a number of forms before removing any from the tank or building.

At such time, the crane is shifted to lower its hook through the central access opening, and a pair of the bridles at the narrow end of one of the forms is attached to the hook. The form is then raised by the crane to hang with its wide end suspended approximately directly underneath its narrow end (see FIG. 19), so that it can be readily hoisted through the access opening. The foregoing steps are repeated until the last form is lifted through the access opening (FIG. 20), leaving a completely empty and unobstructed tank interior.

Figures 21, 22, 23, 24, 25, 26:
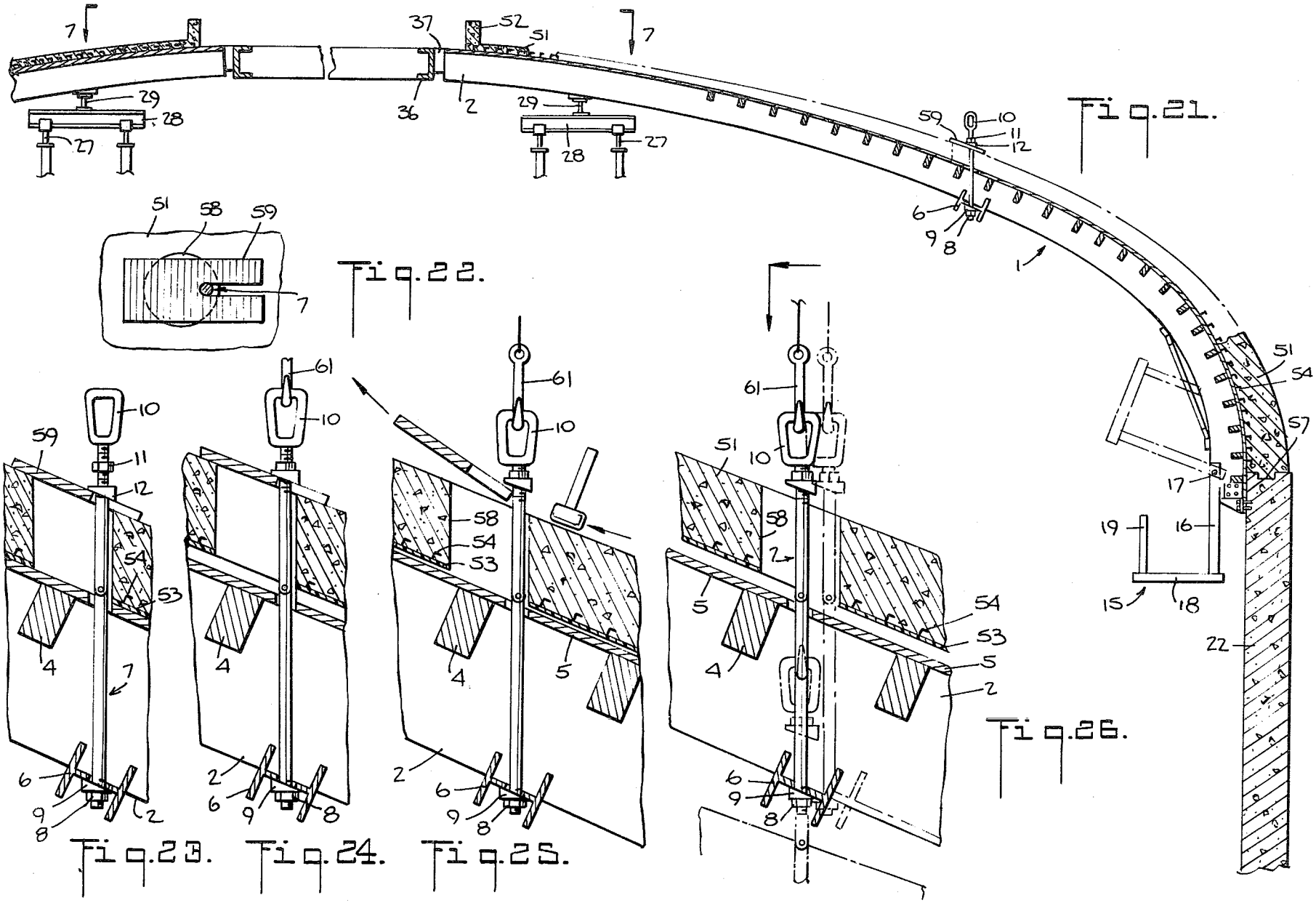
FIG. 21 is a fragmentary cross section in elevation showing the upper portion of the circumscribing wall and the relationship of the form member, the poured concrete roof, the central staging structure, and a center compression ring for absorbing radial loads from the form members.
FIG. 22 is a fragmentary plan view of the region surrounding one of the suspending eyebolts of a form member showing the slotted support plate in place.
FIG. 23 is a fragmentary section view in elevation of the region surrounding the lifting eyebolt of a form member prior to tightening of the nut on the eyebolt against the slotted plate and the lowering of the staging.
FIG. 24 repeats the view of FIG. 23 after tightening of the nut on the eyebolt and after the lowering of the staging structure so that the form member is suspended by engagement of the nut against the slotted plate.
FIG. 25 repeats the view of FIG. 24 after the load of the form member has been picked up by a lifting line hooked to the eyebolt and the nut loosened on the eyebolt, and illustrates the step of removing the slotted plate.
FIG. 26 repeats the view of FIG. 25 and illustrates the initial portion of the step of lowering the form member to the bottom of the tank.

Referring next to FIG. 21, the various features of the form arrangement described above are illustrated in greater detail. These features include the compression ring 36 held in place by wedges 37 to absorb the radial compression forces in the form support beams. Also shown at the other end of the form member are the engagement of bracket 14 with circumscribing wall 22 and joint 57 in wall 22. Studs 54 of the liner 53 hook into the poured concrete roof to secure the liner to the undersurface of the roof.

FIG. 21 also illustrates the folded (dash lines) and operative (solid lines) positions of the work platform 15. When the station is folded out of the way, the form member can be set down with its wide and narrow ends on the ground. In its operative position, the work platform provides ready access to the bolts of support brackets 14 by a workman standing on walkway platform 18.

Finally, FIG. 21 shows a preferred arrangement for suspending the form member from the roof and for facilitating the subsequent lowering operation. As mentioned earlier, before the roof is poured a tubular form of cylindrical collar 58 is placed around eye bolt 7, with its center displaced radially inward from the axis of the eye bolt, as shown more clearly in the enlarged detail of FIG. 23. This collar may be of any suitable stiff material and is used to provide a clear space around the eye bolt when the roof is poured. Alternatively, the space may be filled with cement grout before the roof is poured, to hold the collar in position and to prevent bending of the eye bolt near the upper surface of the form if it is subjected to nonaxial forces. In such a case the collar should be made of some low shear strength material such as cardboard, plastic foam, or the like; so that the plug of cement grout will easily pull away from the surrounding concrete of the roof when the form is subsequently lowered. The plug can be wrapped with sheet resin material.

After the concrete roof has been poured and has set, a slotted bearing plate 59 is slipped underneath nut 11 and tapered washer 12 (see FIG. 23). Plate 11 has a length sufficient to span the diameter of collar 58 and to have sufficient area bearing on the surrounding concrete to safely distribute the weight of the form member to the concrete when the central staging structure is removed.

Turning next to FIGS. 24 through 26, the sequence of steps involved in transferring the weight of each form member to the roof and then subsequently disengaging and lowering the form member are illustrated in detail. As a first step, nut 11 is preferably adjusted to provide approximately one inch of vertical clearance between the bottom of tapered washer 12 and the top surface of bearing plate 59 after the plate has been installed (FIG. 23).

Next, the screw jacks of the central staging structure are retracted, thereby allowing the form member to disengage from the underside of the plastic lining until bearing plate 59 engages the washer and nut (FIG. 24). Retraction of the screw jacks continues, with the cantilevered inner end of the form deflecting as progressively more of its weight is transferred through the eye bolt and bearing plate to the surrounding roof, until the staging structure is finally clear of the form support beam.

After all of the staging supports have been removed from the tank, a predetermined lifting force is applied to eye 10 by a crane hook 61 to allow plate 59 to be knocked out of the way by a hammer 62 (FIG. 25). During preparation for removal of the forms, the lower bolts of brackets 14 are removed. At this point, the upper bolts engaging brackets 14 to the inner face of wall 22 can be removed, thereby allowing the form to hang free.

The crane boom is then moved slightly to shift eyebolt 7 radially inward toward the center of the clearance space provided by collar 58 and also to move the outer end of the form safely away from the wall, (see FIG. 26). It is also desirable to have a guide rope attached to the wide end of the form and handled by a man at the bottom of the tank during the disengaging and lowering steps. The form member then can be lowered to the bottom of the tank.

Figure 27:
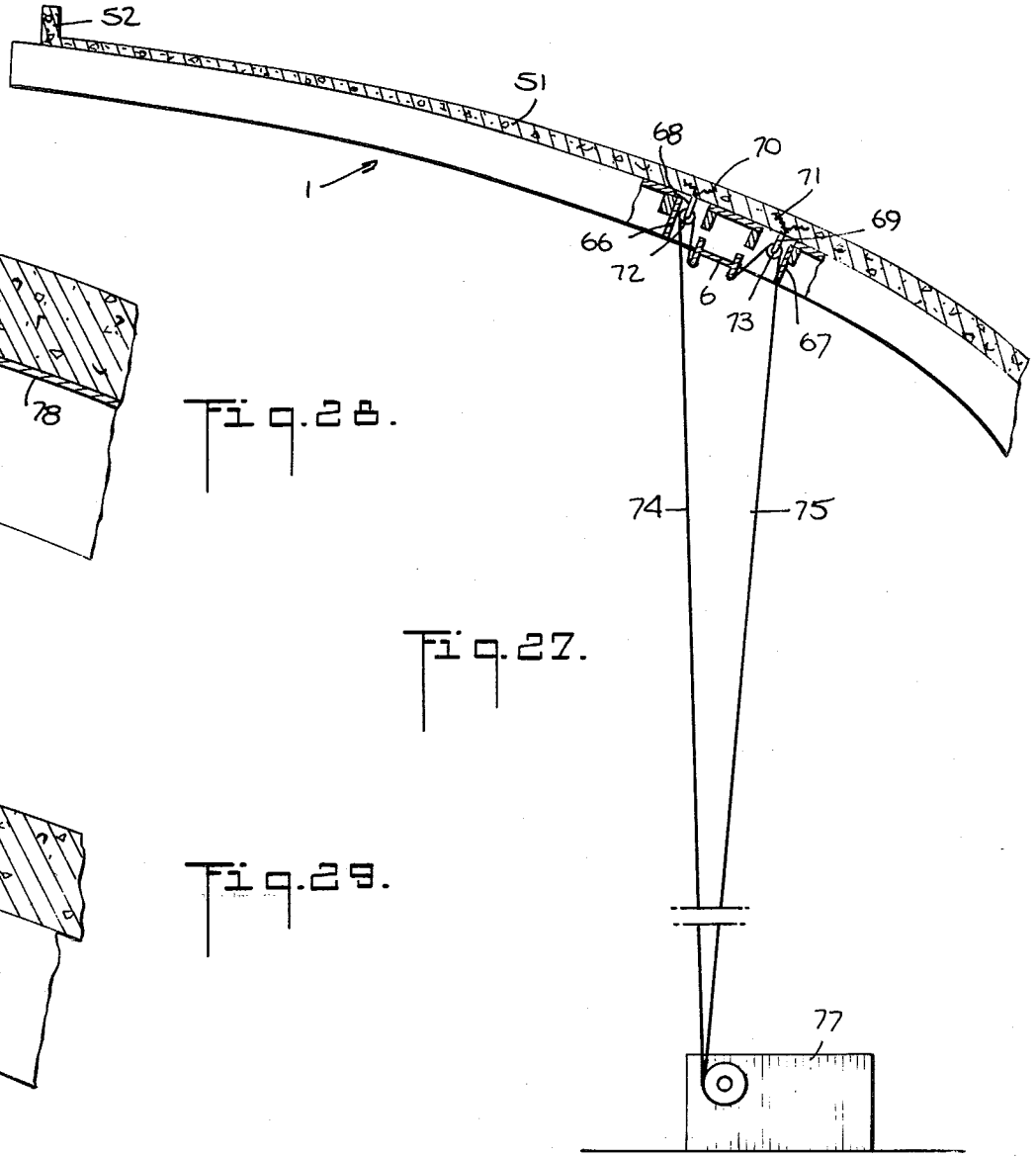
FIG. 27 illustrates an alternative arrangement for lowering the form member to the bottom of the tank structure.

The above-described method of transferring the weight of the form members to the roof and then subsequently lowering them by means of a crane (or other device above the roof) is preferred for efficiency, simplicity, and safety. It is also possible, however, to perform the lowering step from within the tank, if necessary. One arrangement for doing this is illustrated in FIG. 27. In this arrangement, the form member can be provided with trapdoors 66 and 67 in the region of the lifting means to provide access to the roof from underneath the form. Anchor bolts 68 and 69 are positioned on these trap doors with coil anchors 70 and 71, respectively, before the roof is poured. When the concrete roof has cured, the trap doors are opened to allow snatch blocks 72 and 73 to be attached to the roof by anchor bolts 68 and 69, respectively. Cables 74 and 75 are then passed through snatch blocks 72 and 73 and attached at one end to the center of cross beam 6 (or any other suitable point on the form member). The running parts of the cables are then wound around a drum 76 on a winch 77 at the bottom of the tank to permit controlled lowering of the form member.

Figure 28:
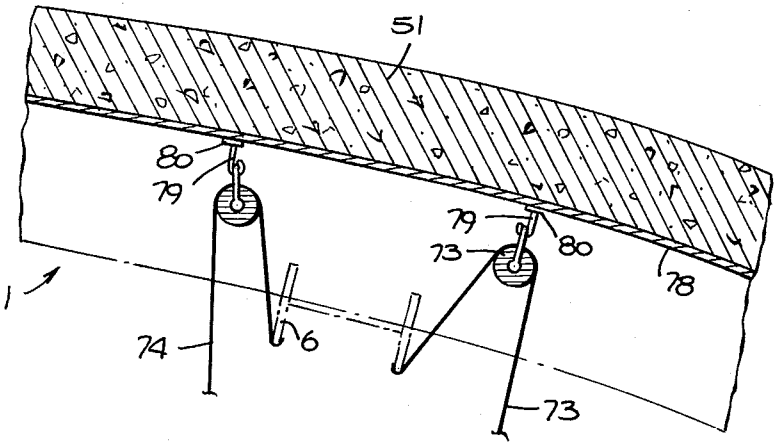
FIG. 28 is a fragmentary view in elevation showing still another arrangement for lowering the form member where the dome overlies a metal vessel.

FIG. 28 shows an alternate arrangement for use with structures, such as reactor vessel containment structures, in which a pressure containment lining 78 of welded steel plates, 3/8 to 5/8 inch thick, is installed over the form members before pouring the concrete roof. In such a case, J-hooks 79 welded to pads 80 are preferably substituted for bolts 68 and 69 of FIG. 27 as attachment means for the snatch blocks 72 and 73. Pads 80 are welded to the undersurface of the steel lining; so that no penetrations are required through the lining.

Figure 29:
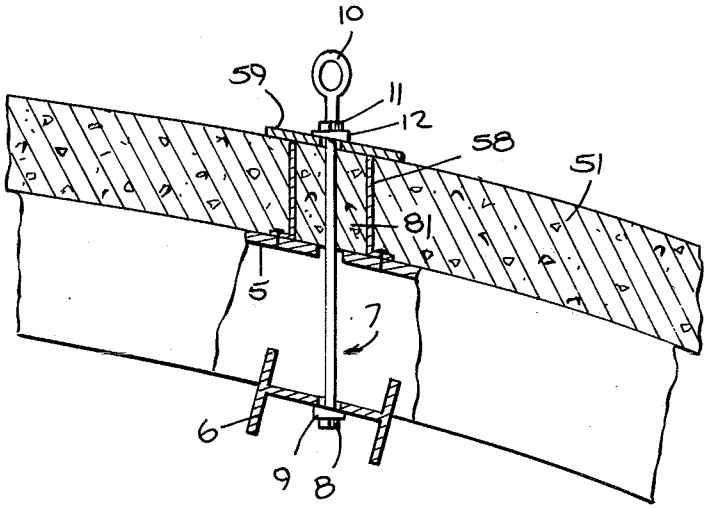
FIG. 29 is a fragmentary section view in elevation showing the eyebolt supported within the form.

FIG. 29 illustrates an alternative method for providing a clearance space around the lifting eyebolt. A collar 58 is positioned around the eyebolt, as before, but the space inside the collar is filled with hardenable material 81, such as concrete or cement mortar. This should be done while the forms are on the ground. The hardened concrete material will then support the eyebolt against bending under lateral forces incurred during the installing and lowering operations. This, in turn, prevents damage to the plywood skin in the region surrounding the eyebolt. The collar should then be wrapped with sheet plastic or other similar material to create a low shear strength joint between the cement plug and the subsequently poured concrete roof to allow the plug to pull out easily when the form member is lowered from the roof.

Other variations from the preferred embodiments of the method and apparatus illustrated and described above will be apparent to those skilled in the art within the scope of the present invention.

What is claimed is:

1. A method of constructing a concrete roof on top of a large structure having an open interior with the aid of a plurality of prefabricated elongated sector-shaped form members, each sector-shaped form member having a wide end and a narrow end with each being disposed at a different opposite end portion of the length thereof, each form member having a sector-shaped upper surface for receiving and supporting a layer of reinforced concrete and an integral supporting beam extending below the upper surface between the ends thereof to enable the form to resist bending mounts applied thereto either by the weight of the form when the form is suspending from a single suspension point disposed intermediate with respect of its ends or by the weight of a layer of concrete on the top surface of the form when the form member is supported only at its ends, the method including the steps of:

erecting a staging extending vertically to a predetermined height above the structure in the center of the interior of the structure, the staging being self-supporting and independent of the structure;

successively positioning each sector-shaped form member with its wide end being supportably engaged by the upper portion of the structure and with the under side of each form member adjacent its narrow end being supportably engaged by the erected staging, such that the upper sector-shaped surface of each form member extends inwardly and upwardly from the structure and is adapted to receive and support a layer of reinforced concrete, each form member being otherwise unsupported, and each form member being flanked by adjacent form members to provide a substantially continuous upper surface having a centrally disposed access opening therein which is substantially in alignment with the narrow ends of the form members;

covering the upper surfaces of the form members with a layer of reinforced concrete to form a roof having an opening corresponding to the access opening in the continuous upper surface provided by the form members and that is large enough to permit removal of each form member intact through said opening;

suspending each of the form members at said single suspension point from the roof after the concrete has cured to a predetermined strength, thereby enabling the roof to carry up to all the weight of each form member that was heretofore carried by the structure and the erected staging;

removing the staging from engagement with the form members and from the interior of the structure through the opening in the roof, the suspending of each form from the roof supporting each form member upon the removing of the staging;

applying a lifting force to a form member at said suspension point thereof to remove the load of the form member at said suspension point away from the roof;

disengaging from the structure the wide end of the form member to which the lifting force is applied;

reducing the lifting force on the form member to which the lifting force is applied to lower the form member out of engagement with the inner surface of the roof;

repeating the steps of applying a lifting force, disengaging the wide end, and lowering for each of the form members; and removing each form member intact through said opening in the roof.

2. A method of constructing a concrete roof in accordance with claim 1 in which the step of lowering each form member includes engaging the form member substantially at the predetermined location thereon from which the form member is suspended from the roof.

3. A method of constructing a concrete roof in accordance with claim 1 in which the step of lowering each form member out of engagement with the roof comprises lowering each form to the floor of the interior of the structure.

4. A method of constructing a concrete roof in accordance with claim 1 and including the additional steps of:

attaching a lifting line to each form member after its disengagement from the roof, the lifting line being attached near its narrow end such that the form member will hang suspended from the lifting line with the wide end of the form approximately directly underneath the narrow end; and hoisting each form member by the lifting line through the access opening.

5. A method of construction according to claim 1 wherein each form member has a lifting means attached at said suspending location of the form member, said suspending location being located approximately on a vertical line through the center of gravity of the form member when the form member is positioned on the structure, and the suspending step includes suspending the form member by said lifting means from the cured concrete roof.

6. A method of construction according to claim 1 wherein each form member has an elongated lifting means extending above its upper surface approximately coaxial with a vertical line through the center of gravity of the form member when the form member is positioned on the structure, the lifting means carrying a stop element spaced above the upper surface of the form member, wherein the step of suspending the form member after the layer of concrete has cured comprises:

placing a bearing means on top of the concrete layer adjacent to the lifting means and spaced below the stop element carried by the lifting means, the bearing means being adapted to distribute the weight of the form member to the concrete roof when engaged by the stop element of the lifting means, and retracting the height of the central support staging by a distance sufficient for the stop element to engage the bearing means.

7. A method of construction according to claim 6 comprising the further steps of:

attaching one end of an elongated tension member to the lifting means; applying a predetermined upward force to the lifting means through the tension member; and removing the bearing means from the way of the stop element.

8. A method of construction according to claim 7 comprising the additional step of:

placing a stiff cylindrical collar on the upper surface of each form member in radially spaced relation around the elongated lifting means before covering the form member with the layer of concrete to facilitate disengaging the form member from the circumscribing wall and lowering the form member to the bottom of the structure.

9. A method of construction according to claim 8 wherein the wide end of each form member is supportably engaged with the structure by means of at least one angle bracket bolted to the inner face of the supporting structure, and the step of disengaging the wide end of the form member from the structure comprises:

unbolting the angle bracket from the structure; and shifting the suspending location radially inward to permit the form member to move away from the inner face of the wall for performing the subsequent lowering step without hitting the wall.

10. A method of construction according to claim 7 comprising the additional steps of:

placing a cylindrical collar on the upper surface of each form member in radially spaced relation around the elongated lifting means before covering the form with the layer of concrete; and filling the space between the collar and the elongated lifting means with hardenable material to hold the collar in place and provide support for the lifting means, the collar material being such as to provide a low shear strength joint between the hardenable material and the surrounding layer of concrete to permit separation of the plug from the roof when the form member is lowered after the concrete has cured, thereby providing a clearance space around the tension member to facilitate disengaging the wide end of the form member from the circumscribing wall and lowering the form member to the bottom of the structure.

11. A method of construction according to claim 10 wherein the wide end of each form member is supportably engaged with the structure by means of at least one angle bracket bolted to the inner face of the supporting wall, and the step of disengaging the wide end of the form member from the circumscribing wall comprises:

unbolting the angle bracket from the wall; and shifting the suspending location radially inward to permit the form member to move away from the inner face of the structure for performing the subsequent lowering step without hitting the wall.

12. A method of construction according to claim 1 wherein each form member is positioned on the structure by the steps of:

applying an upward force to the form member at a point such that the form member hangs suspended in approximately the attitude desired when it is in position on the structure, lifting the form member to a position directly above its intended location on the structure; lowering the form member further and simultaneously guiding the narrow end of the form member until it rests on the center staging; and lowering the former member further and simultaneously guiding the wide end of the form member until it is supportably engaged by the wall.

13. A method of construction according to claim 12 comprising the steps of:

connecting a walkway near the wide end of each form member for pivoting movement about an axis parallel to said wide end; pivoting the walkway upward against the inside of the form member before lifting the form member into position on the structure to minimize the possibility of damage to the walkway and facilitate clearance through the access opening; and pivoting the walkway downward to a horizontal position below the end of the form member after it has been positioned on the structure to provide an integral work platform to facilitate the supportable engagement of the succeeding form member by the structure.

14. A method of construction according to claim 1 comprising the additional steps of:

covering the upper surface of each form member with a pliable sheet of plastic material, before the form member is positioned on the structure, the sheet being provided with a multiplicity of spaced studs extending from its upper surface, and overlapping each joint between adjacent form members after they are positioned on the structure with a strip of plastic material for sealing the joints when the forms are covered with the concrete layer, the studs serving to anchor the plastic sheets to the underside of the layer when the concrete has cured, whereby the plastic sheets facilitate stripping of the forms and provide a lining for the roof.

* * * * *

UNITED STATES PATENT OFFICE

CERTIFICATE OF CORRECTION

Patent No. 4,076,777 Dated February 28, 1978

Inventor(s) Vladimir Petrovitch

It is certified that error appears in the above-identified patent and that said Letters Patent are hereby corrected as shown below:

Column 2, line 37, after "access", insert -- opening --;

Column 2, line 43, after "roof" (second occurrence), insert -- has --;

Column 3, line 38, delete "in" and insert -- is --;

Column 5, line 41, delete "The" and insert -- the --;

Column 8, line 16, delete "wit" and insert -- with --;

Column 11, line 29, delete "of" and insert -- or --;

Column 13, line 18, delete "mounts" and insert -- moments --;

Signed and Sealed this

First Day of August 1978

[SEAL]

*Attest:*

RUTH C. MASON
*Attesting Officer*

DONALD W. BANNER
*Commissioner of Patents and Trademarks*